US006930283B2

(12) United States Patent
Reissner et al.

(10) Patent No.: US 6,930,283 B2
(45) Date of Patent: Aug. 16, 2005

(54) ELECTRICALLY HEATABLE GLOW PLUG AND METHOD FOR PRODUCING SAID ELECTRICALLY HEATABLE GLOW PLUG

(75) Inventors: Andreas Reissner, Stuttgart (DE); Armin Kussmaul, Bietigheim-Bissingen (DE); Steffen Carbon, Schorndorf (DE); Christoph Kern, Aspach (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/451,772

(22) PCT Filed: Jul. 16, 2002

(86) PCT No.: PCT/DE02/02596

§ 371 (c)(1),
(2), (4) Date: Nov. 20, 2003

(87) PCT Pub. No.: WO03/038340

PCT Pub. Date: May 8, 2003

(65) Prior Publication Data

US 2004/0084436 A1 May 6, 2004

(30) Foreign Application Priority Data

Oct. 23, 2001 (DE) ..... 101 52 175
Nov. 23, 2001 (DE) ..... 101 57 466

(51) Int. Cl.[7] ..... F23Q 7/00
(52) U.S. Cl. ..... 219/270; 123/145 A
(58) Field of Search ..... 219/270, 544, 219/260, 553; 123/145 A, 145 R; 361/264–266; 29/611

(56) References Cited

U.S. PATENT DOCUMENTS

| | | | | | |
|---|---|---|---|---|---|
| 2,690,491 | A | * | 9/1954 | Calvert | 338/236 |
| 3,596,057 | A | * | 7/1971 | Arntz et al. | 338/233 |
| 4,639,712 | A | | 1/1987 | Kobayashi et al. | |
| 6,043,459 | A | * | 3/2000 | Jakobi et al. | 219/270 |
| 2004/0112893 | A1 | * | 6/2004 | Okuda | 219/544 |

FOREIGN PATENT DOCUMENTS

| | | | |
|---|---|---|---|
| DE | 2625752 | * | 12/1977 |
| DE | 197 56 988 | | 12/1997 |
| DE | 199 28 037 | | 6/1999 |
| EP | 0 079 385 | | 5/1983 |
| JP | 52-108346 | * | 9/1977 |
| JP | 54-61340 | * | 5/1979 |
| JP | 2-155186 | * | 6/1990 |
| JP | 4-123785 | * | 4/1992 |
| JP | 5-283149 | * | 10/1993 |

* cited by examiner

*Primary Examiner*—Robin O. Evans
*Assistant Examiner*—Vinod Patel
(74) *Attorney, Agent, or Firm*—Kenyon & Kenyon

(57) ABSTRACT

An electrically heatable glow plug and a method for manufacturing an electrically heatable glow plug are proposed that enable a protection of a heating coil of the glow plug against nitridation and evaporation of the aluminum from the heating conductor alloy. The glow plug includes a glow tube that is closed at the end, into which the electrically conductive heating coil is inserted, the heating coil being formed at least partially of aluminum, in particular of an aluminun-iron-chromium alloy. In the glow tube, oxygen donors are provided in order to form an aluminum oxide layer on the surface of the heating coil before or during the heating of the heating coil.

21 Claims, 2 Drawing Sheets

ELECTRICALLY HEATABLE GLOW PLUG AND METHOD FOR PRODUCING SAID ELECTRICALLY HEATABLE GLOW PLUG

FIELD OF THE INVENTION

The present invention relates to an electrically heatable glow plug and a method for manufacturing an electrically heatable glow plug.

BACKGROUND INFORMATION

German Patent No. 19928037 describes an electrically heatable glow plug for internal-combustion engines that includes a glow tube that is closed at its end and is corrosion-resistant, and that accommodates a filling of a compressed, electrically nonconductive powder in which there is embedded an electrically conductive filament. The filament includes a heating coil. This heating coil is formed from an iron-chromium-aluminum alloy. In the area of the heating coil, the electrically conductive filament is hardened on its surface. In this way, the filament can withstand the mechanical stress during the compression process without damage.

German Patent No. 19756988 describes an electrically heatable glow plug for internal-combustion engines that has a glow element made of a corrosion-resistant metal jacket. In the glow element there is contained a compressed powder filling. An electrically conductive filament is embedded in the filling. In order to increase the life span of the filament, a getter material is provided in the glow element for the binding of the oxygen contained in the compressed powder filling. The getter material can be distributed in the compressed powder filling in the form of electrically nonconductive particles. These particles can be made of silicon or metal oxides of metals that oxidize in several oxidation stages and that have a higher affinity to oxygen than does the filament material; in the initial state, the getter material can contain the metal oxides in their first oxidation stage.

European Published Patent Application No. 0079385 describes a heating element in which a filament is situated in a sheath and is embedded in an electrically insulating powder. The powder has 0.1 to 10 weight percent of an oxide, and in this way prevents the oxidation of the metallic portion of the filament.

SUMMARY OF THE INVENTION

In contrast, the electrically heatable glow plug and the method for manufacturing an electrically heatable glow plug have the advantage that in the glow tube oxygen donors are provided, in order to form a layer of aluminum oxide on the surface of the heating coil before or during the heating of the heating coil. In this way, in the case of a penetration of air into the glow tube, the formation of nitrides in the edge layers of the heating coil, and thus a local increase of the electrical resistance and a premature failure of the heating coil, are prevented.

A further advantage is that an evaporation of aluminum from the alloy can largely be suppressed.

An economical realization of the supply of oxygen donors results when the heating coil in the glow tube is embedded in a first insulating powder, the first insulating powder including a material that acts as an oxygen donor.

It is particularly advantageous if the oxygen donor is formed as a metal oxide that can oxidize in several oxidation stages and that is present in its highest oxidation stage. In this way, the oxygen release of the metal oxide is promoted considerably.

The same holds correspondingly if the oxidic ceramic powder includes a metal oxide that, under reducing conditions, can release oxygen through defect formation.

It is also advantageous if the oxygen donors are brought into the glow tube in the form of oxygen molecules under pressure. In this way, through the pressure the concentration of oxygen in the glow tube can be increased, and through the oxygen molecules an oxidation can be realized on the heating coil surface for the formation of aluminum oxide, without requiring a heating of the heating coil by a heating current for this purpose. In this way, the heating coil can be protected from nitridation by an oxide layer already before the first operation, i.e., before the first heating by a heating current.

A further advantage is that a control coil, connected to the heating coil, is embedded in a second insulating powder that is as free as possible of oxygen donors and/or includes getter material for the binding of oxygen. In this way, a material can be used for the control coil that does not form a protective oxide layer under the influence of oxygen donors, as is the case for example for cobalt-iron alloys. A corrosion of the control coil can thus be prevented, or at least considerably delayed, through the use of the second insulating powder that is as free as possible of oxygen donors.

With the use of getter material in the second insulating powder, disturbing oxygen molecules in the area of the control coil can be bound.

DETAILED DESCRIPTION

Figure 1:
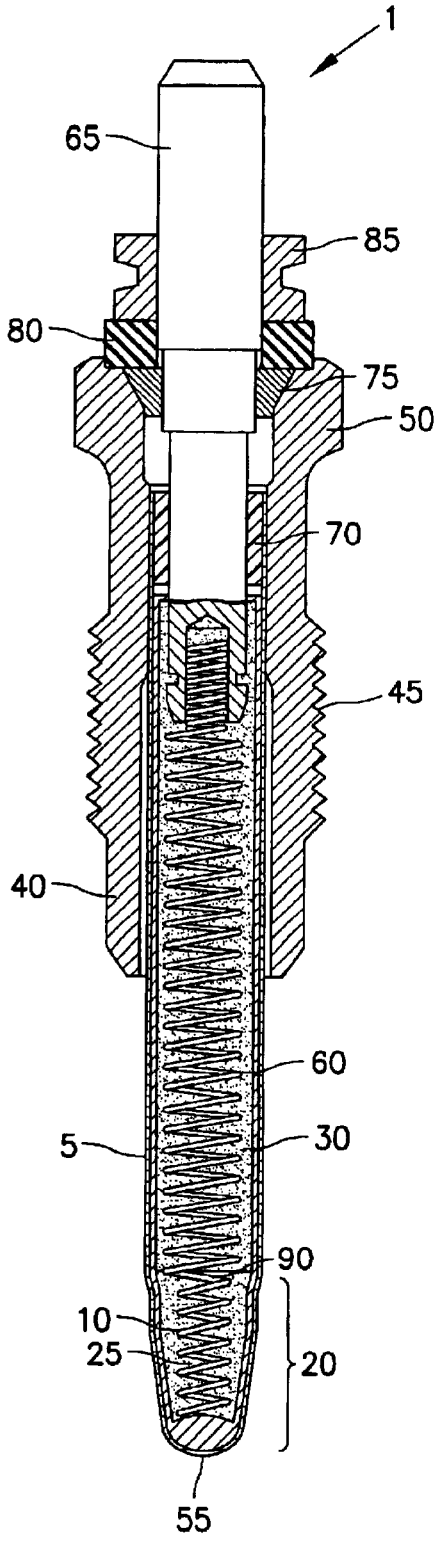
FIG. 1 shows a first exemplary embodiment of an electrically heatable glow plug according to the present invention.

In FIG. 1, reference character 1 designates a glow plug, formed as a sheathed-element glow plug, for an internal-combustion engine. Sheathed-element glow plug 1 includes a plug housing 40 having a threading 45 for screwing into a cylinder head of the internal-combustion engine. Plug housing 40 further includes a hexagon 50, via which the sheathed-element glow plug or plug housing 40 can be screwed into or out of the cylinder head using a twisting tool, for example a wrench for hexagon nuts. A glow tube 5 is pressed into plug housing 40, which is formed in the shape of a tube, and this glow tube protrudes from plug housing 40 at the side of the combustion chamber, i.e., at the end of plug housing 40 situated opposite hexagon 50. At the side of the combustion chamber, glow plug 5 is closed at its end. In an area 20 at the combustion-chamber-side tip 55, formed in this way, of glow plug 5, the cross-section of glow plug 5 can be reduced, as is the case in this example. However, a reduction of this cross-section is not absolutely necessary. Only area 20, having reduced cross-section, of sheathed-element glow plug 1 protrudes into the combustion chamber. In area 20 having reduced cross-section, glow plug 5 has a heating coil 10 that is welded to combustion-chamber-side tip 55 of glow tube 5. Adjoining heating coil 10 is a control coil 60, situated in the area of glow tube 5, whose cross-section is not reduced. At the end of glow tube 5 situated away from the combustion chamber, control coil 60 contacts a connecting bolt 65 that can be connected with the positive pole of a vehicle battery. In the direction towards the opening of plug housing 40 situated away from the combustion chamber, glow tube 5 is sealed, still inside plug housing 40, against environmental influences by a Viton ring 70. A further sealing ring 75 seals connecting bolt 65, which protrudes from plug housing 40 away from the combustion chamber, against plug housing 40. An insulating disk 80, connected to sealing ring 75 away from the combustion chamber, is used to electrically insulate connecting bolt 65 from plug housing 40, and thus electrically insulates connecting bolt 65 from plug housing 40, whose electrical potential is at vehicle ground. A ring nut 85 presses insulating disk 80 onto plug housing 40, and presses sealing ring 75 into plug housing 40.

Glow tube 5 is of metallic construction, and, due to being pressed into plug housing 40, its electrical potential is likewise at vehicle ground. Heating coil 10 is welded, with control coil 60, to a connection point 90.

The function of Viton ring 70 is of considerable importance, because it is made of a soft, insulating material, and thus not only seals connecting bolt 65 in electrically insulating fashion against plug housing 40 at its end protruding into glow tube 5 for the contacting of control coil 60, but also prevents the penetration of air into glow tube 5, which is open at its end away from the combustion chamber. This sealing should be as reliable as possible.

Heating coil 10 is made for example of a ferritic steel having an aluminum portion, for example of an iron-chromium-aluminum alloy. The control coil can for example be made of pure nickel or of a cobalt-iron alloy, having a portion of 6–18 weight percent cobalt, and has the function of a control resistance having a positive temperature coefficient.

In addition, in glow tube 5 an electrically insulating powder filling 25, 30, which is compressed after the hammering of glow tube 5, is provided, which ensures that heating coil 10 and control coil 60 in the interior of glow tube 5 are housed and fixed in stationary fashion, as well as being electrically insulated against glow tube 5, apart from tip 55 of glow tube 5. As a powder filling, in general magnesium oxide is used. Moreover, the powder filling provides a thermal connection between glow tube 5 and heating coil 10, or control coil 60.

Given the presence of sufficient oxygen, the alloy of heating coil 10 normally protects itself in a short time against further corrosion through the formation of a thin $Al_2O_3$ layer. However, this precondition is not met in sheathed-element glow plug 1, due to an initial lack of oxygen that is as a rule initially present. During the cyclical thermal loading of the sheathed-element glow plug in its use in the cylinder head, air can penetrate into glow tube 5 despite sealing ring 75 and Viton ring 70. This leads to a simultaneous reaction of the material of heating coil 10 with oxygen and nitrogen. In contrast to oxygen, which forms a protective aluminum oxide layer in the surface of heating coil 10, nitrogen causes an interior nitridation, i.e., formation of aluminum nitride in the material of heating coil 10. The consequence is a local increase of the electrical resistance of heating coil 10, resulting in a higher voltage drop, and thus a greater heating at heating coil 10; this can cause a premature failure of heating coil 10.

For this reason, a material that acts as an oxygen donor is added to the insulating powder filling, said material releasing oxygen at high temperatures and thus promoting the formation of a protective aluminum oxide layer on heating coil 10. In this way, in the case of a penetration of air into glow tube 5, the formation of nitrides in the edge layers of heating coil 10 is prevented. The aluminum oxide layer is here at least partially realized by a heating current already during the first heating of heating coil 10, in which temperatures of greater than 1000 degrees Celsius are reached.

If the material of control coil 60 has no aluminum portion and also no silicon portion, as in the example described here, then it does not form a protective oxide layer with the oxygen released by the oxygen donors, but rather corrodes. This should be prevented. For this reason, in this case the material of the insulating powder filling acting as an oxygen donor is added only in area 20 at tip 55 of glow tube 5, in which heating coil 10 is located. The material acting as an oxygen donor should thus be present only in the area of heating coil 10, and not in the area of control coil 60. For this purpose, in the assembly of sheathed-element glow plug 1, first glow tube 5 is filled with the insulating powder having the material acting as an oxygen donor until heating coil 10 is embedded therein as completely as possible, and control coil 60 does not come into contact with the material acting as an oxygen donor even after a hammering of glow tube 5. The insulating powder filling enriched with the material acting as an oxygen donor is designated with reference character 25 in FIG. 1, and is referred to in the following as the first insulating powder. The insulating powder with which glow tube 5 is subsequently filled, and in which control coil 60 is embedded, should in this example contain no material acting as an oxygen donor, and should for example be formed from pure magnesium oxide. In this way, the oxidation is supported only in the area of heating coil 10, so that both a nitridation of heating coil 10 and a corrosion of control coil 60 can be prevented. The insulating powder, which is free of materials acting as oxygen donors, is designated in FIG. 1 with reference character 30, and represents a second insulating powder. Alternatively, or in addition, second insulating powder 30 can include a getter material for the binding of oxygen, such as for example Si, Ti, Al, or reduced metal oxides, such as for example FeO, $Ti_2O_3$. Given an electrically conductive getter material, such as for example Si, Ti, Al, second insulating powder 30 contains electrically insulating material, such as for example MgO, in a significantly greater concentration than the getter material.

The material acting as an oxygen donor can for example be formed as an oxidic ceramic powder. Here, the ceramic powder can be a metal oxide of a metal that can oxidize in several oxidation stages. In order to promote the releasing of oxygen, in an initial state this metal oxide can be present in its highest oxidation stage. Here, for example $TiO_2$ can be used as an oxygen donor.

A further possibility is to use as an oxygen donor an oxidic ceramic powder or metal oxide that releases oxygen under reducing conditions, such as those present in area 20 at tip 55 of glow tube 5 due to the aluminum portion of heating coil 10, so that a defect results in the crystal grid of the relevant metal oxide due to missing oxygen atoms. $ZrO_2$ can for example be selected as such an oxygen donor.

A content of the material acting as an oxygen donor in first insulating powder 25 in a range from as low as approximately 0.1 weight percent up to approximately 20 weight percent has proven sufficient for the introduction of the oxidation on heating coil 10 upon heating; the remaining portion of first insulating powder 25 can for example be formed by magnesium oxide.

Figure 2:
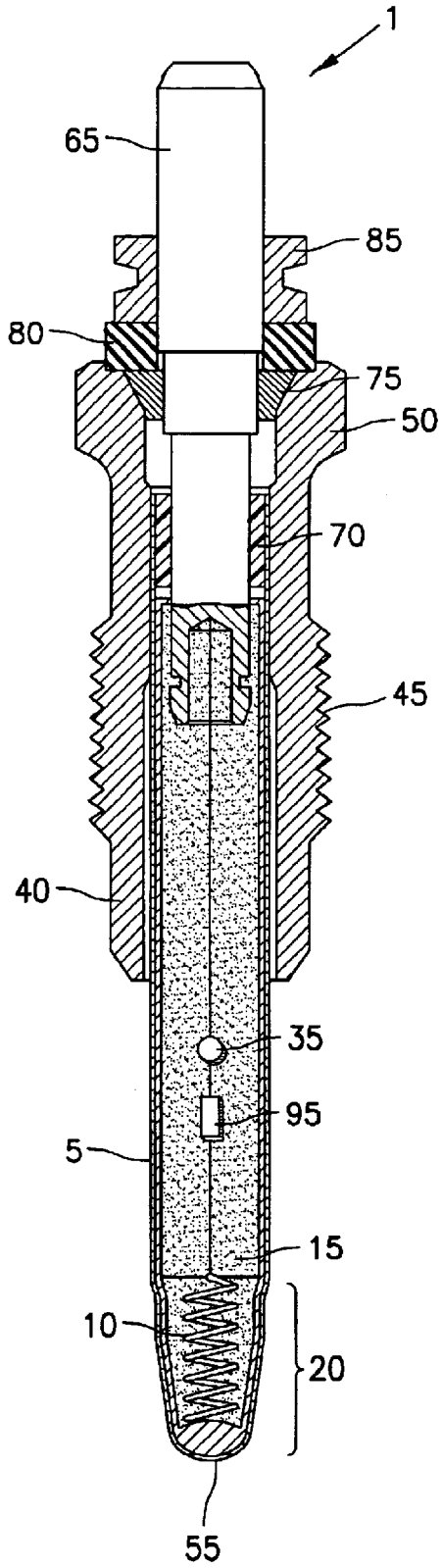
FIG. 2 shows a second exemplary embodiment of an electrically heatable glow plug according to the present invention.

FIG. 2 shows a second exemplary embodiment of a glow plug according to the present invention, in which identical reference characters designate the same elements as in FIG. 1. In contrast to the first specific embodiment according to FIG. 1, in the second specific embodiment according to FIG. 2 glow tube 5 does not have a control coil, but rather has an electronic control element 95 that is protected against oxidation, which can for example include a temperature sensor and a keying, dependent on the determined temperature, of the current supplied to heating coil 10, and which is not described here in more detail. A control coil or a control element can also be omitted entirely. Moreover, instead of first insulating powder 25 and second insulating powder 30, a third insulating powder 15 is provided in the entire area of glow tube 5, this third powder being made of an electrically insulating material, for example magnesium oxide, and being free of oxygen donors. Heating coil 10 is connected with connecting bolt 65 via control element 95; here control element 95 can also be situated as far from the combustion chamber as possible, so that it will not be heated too strongly. It can now be provided that before the first operation of sheathed-element glow plug 1, an opening 35 is bored into glow tube 5; here opening 35 should be situated outside area 20 at tip 55 of glow tube 5 having heating coil 10, because this area could be too sensitive for a boring due to its reduced cross-section. If, however, there are no stability problems in area 20 at tip 55 of glow tube 5, it is also conceivable to make bored opening 35 there; i.e., directly in the area of heating coil 10. Here, opening 35 is made only after heating coil 10 and, if necessary, control element 95 have been brought into area 20 at tip 55 of glow tube 5, and glow tube 5 has been filled with third insulating powder 15. Only then is opening 35 bored into glow tube 5. Through opening 35, oxygen molecules are then brought into glow tube 5 under a gas atmosphere with controlled partial pressure. This process can for example last between approximately one hour and approximately 20 hours; the limits of this time span can also be adjusted upward or downwards. Subsequently, opening 35 formed by the boring is again closed. The closing can for example take place through welding. Through the controlled partial pressure, the concentration of oxygen in glow tube 5 is increased. The higher the partial pressure is, the higher the concentration of the oxygen in glow tube 5 becomes. Due to the high concentration of oxygen, and above all due to the presence of pure oxygen molecules, an oxidation on the surface of heating coil 10 can be accelerated, so that a passivation of heating coil 10 through the formation of a thin $Al_2O_3$ layer on the surface of heating coil 10 can be realized in a short time, already before or during the first operation of sheathed-element glow plug 1 in the internal-combustion engine, the $Al_2O_3$ layer here exercising a protective function and, in the case of a penetration of small quantities of air during the operation of the sheathed-element glow plug, preventing the formation of nitrides on heating coil 10. In this way, the life span of sheathed-element glow plug 1 can be increased. In this case, this takes place through pre-oxidation of heating coil 10 before the first setting into operation of sheathed-element glow plug 1. Through corresponding predetermination of the partial pressure for the bringing of oxygen into glow tube 5, and given corresponding predetermination of the time in which the oxygen is brought into glow tube 5, a protective layer can be produced on heating coil 10 that is defined in its composition; in this example it is formed as an aluminum oxide layer.

If the oxygen brought into glow tube 5 in this way is also distributed outside the area having heating coil 10 in glow tube 5, the use of a control coil susceptible to oxidation and corrosion is not recommended in the second exemplary embodiment, and the use of a control element that is resistant to oxidation and to corrosion, as described for example on the basis of control element 95, or the omission of a control coil or control element, is to be preferred.

What is claimed is:

1. An electrically heatable glow plug for an internal-combustion engine, comprising:

an electrically conductive heating coil; and a glow tube closed at an end thereof, into which the electrically conductive heating coil is inserted, the electrically conductive heating coil being formed at least partially from a material including aluminum, wherein:

an oxygen donor is provided in the glow tube in order to form an aluminum oxide layer on a surface of the electrically conductive heating coil one of before and during a heating of the electrically conductive heating coil.

2. The glow plug as recited in claim 1, wherein:

the material includes an aluminum-iron-chromium alloy.

3. The glow plug as recited in claim 1, wherein:

the electrically conductive heating coil is embedded in a first insulating powder, and the first insulating powder includes a material that acts as the oxygen donor.

4. The glow plug as recited in claim 3, wherein:

the material acting as the oxygen donor includes an oxidic ceramic powder.

5. The glow plug as recited in claim 4, wherein:

the oxidic ceramic powder includes a metal oxide of a metal that is able to oxidize in several oxidation stages.

6. The glow plug as recited in claim 5, wherein:

the metal oxide includes TiO2.

7. The glow plug as recited in claim 5, wherein:

in an initial state the metal oxide is present in its highest oxidation stage.

8. The glow plug as recited in claim 4, wherein:

the oxidic ceramic powder includes a metal oxide that under a reducing condition is able to release oxygen through defect formation.

9. The glow plug as recited in claim 8, wherein:

the metal oxide includes ZrO2.

10. The glow plug as recited in claim 3, wherein:

a content of the material acting as the oxygen donor is in a range from approximately 0.1 weight percent to approximately 20 weight percent of the first insulating powder.

11. The glow plug as recited in claim 1, wherein:

the oxygen donor is introduced into the glow tube as oxygen molecules under pressure.

12. A method for manufacturing an electrically heatable glow plug for an internal-combustion engine, comprising:

forming an electrically conductive heating coil at least partially of a material including aluminum;

inserting the electrically conductive heating coil into a glow tube that is closed at an end thereof; and before operating the glow plug, introducing an oxygen donor into the glow tube in order to form an aluminum oxide layer on a surface of the electrically conductive heating coil one of before and during a heating of the electrically conductive heating coil.

13. The method as recited in claim 12, wherein:

the material includes an aluminum-iron-chromium alloy.

14. The method as recited in claim 12, further comprising:

inserting the electrically conductive heating coil into an area of a tip of the glow tube; and after the inserting into the tip of the glow tube, filling the glow tube with a first insulating powder that includes a material acting as an oxygen donor, so that the electrically conductive heating coil is embedded as completely as possible in the first insulating powder.

15. The method as recited in claim 14, further comprising:

subsequent to the filling of the glow tube with the first insulating powder, filling the glow tube with a second insulating powder that is at least one of:

as free as possible of the oxygen donor, and includes getter material for a binding of oxygen; and embedding in the second insulating powder a control coil.

16. The method as recited in claim 15, wherein:

the control coil includes a cobalt-iron alloy and adjoins the electrically conductive heating coil.

17. The method as recited in claim 15, wherein:

the second insulating powder is based on MgO.

18. The method as recited in claim 12, further comprising:

inserting the electrically conductive heating coil into an area of a tip of the glow tube;

filling the glow tube with a first insulating powder; and after the inserting into the area of the tip of the glow tube and after the filling of the glow tube, performing the following:

boring an opening into the glow tube, introducing oxygen molecules under pressure into the glow tube through the opening of the glow tube, and sealing the opening formed by the boring.

19. The method as recited in claim 18, wherein:

the sealing is performed by welding.

20. The method as recited in claim 18, wherein:

the oxygen molecules are introduced into the glow tube for a predetermined time.

21. The method as recited in claim 20, wherein:

the predetermined time is between approximately one hour and approximately 20 hours.

* * * * *